US005589227A

United States Patent [19]

Falia et al.

[11] Patent Number: 5,589,227

[45] Date of Patent: Dec. 31, 1996

[54] METHOD FOR PRESERVING ROLLERS IMMERSED INTO THE MOLTEN ALLOY BATH FOR EXTENDING THE OPERATING LIFE THEREOF

[75] Inventors: Horacio C. Falia, Remedios de Escalada; Carlos I. Rojas, Lanús-Buenos Aires, both of Argentina

[73] Assignee: Comesi S.A.I.C., Buenos Aires, Argentina

[21] Appl. No.: 413,310

[22] Filed: Mar. 30, 1995

[30] Foreign Application Priority Data

Aug. 17, 1994 [AR] Argentina ..... 329118

[51] Int. Cl.[6] ..... B05D 1/00

[52] U.S. Cl. ..... 427/348; 427/349; 427/356; 427/359; 427/434.2

[58] Field of Search ..... 118/63, 704, 104, 118/118, 123, 203, 244, 261, 262, 413, 414; 427/348, 349, 356, 359, 428, 434.2; 162/281; 101/157, 169, 365; 15/256.5, 256.51

[56] References Cited

U.S. PATENT DOCUMENTS

| | | | |
|---|---|---|---|
| 3,779,206 | 12/1973 | Sato et al. | 118/63 |
| 4,172,911 | 10/1979 | Michels | 118/63 |
| 4,288,476 | 9/1981 | Wald et al. | 427/349 |
| 4,719,129 | 1/1988 | Caudill | 427/348 |
| 5,072,689 | 12/1991 | Nakagawa et al. | 118/419 |
| 5,393,344 | 2/1995 | Oyagi et al. | 118/63 |

*Primary Examiner*—Laura Edwards
*Attorney, Agent, or Firm*—Kuhn and Muller

[57] ABSTRACT

A mechanical device is provided for scraping rollers immersed into an alloy bath through gas feeding, which extends the life of the rollers from several days to several weeks. The device has pairs of scrapers with hard steel cutting edges acting against the roller surfaces along with the fluid action of an inert gas injected through the inner portion of the mechanical scraper.

3 Claims, 1 Drawing Sheet

METHOD FOR PRESERVING ROLLERS IMMERSED INTO THE MOLTEN ALLOY BATH FOR EXTENDING THE OPERATING LIFE THEREOF

FIELD OF THE INVENTION

The present invention relates to a device for extension of the life of idle rollers for a steel sheet to be coated with non-metal alloys, immersed into baths of such alloying elements in a molten state.

BACKGROUND OF THE INVENTION—PRIOR ART

It is know that non-ferrous alloys attack the structural steel of rollers working within the alloys, wherein the rollers are provided for guiding the steel band being coated with the alloys. It is also known that this attack of the alloys against the rollers limits the useful life of the rollers to only a few days, due to the building up of intermetallic alloys of the bath upon the roller steel on the roller surfaces. This accumulation upon thickening of the alloys produces protuberances, and deformations of the original cylindrical shape of the rollers. These protuberances and deformations alter the plane of the steel sheet being coated, which is the reason why rejections of the final steel sheet product occur, which causes frequent production shutdowns for replacing of the rollers.

DETAILED DESCRIPTION OF THE INVENTION

Figures 1, 2:
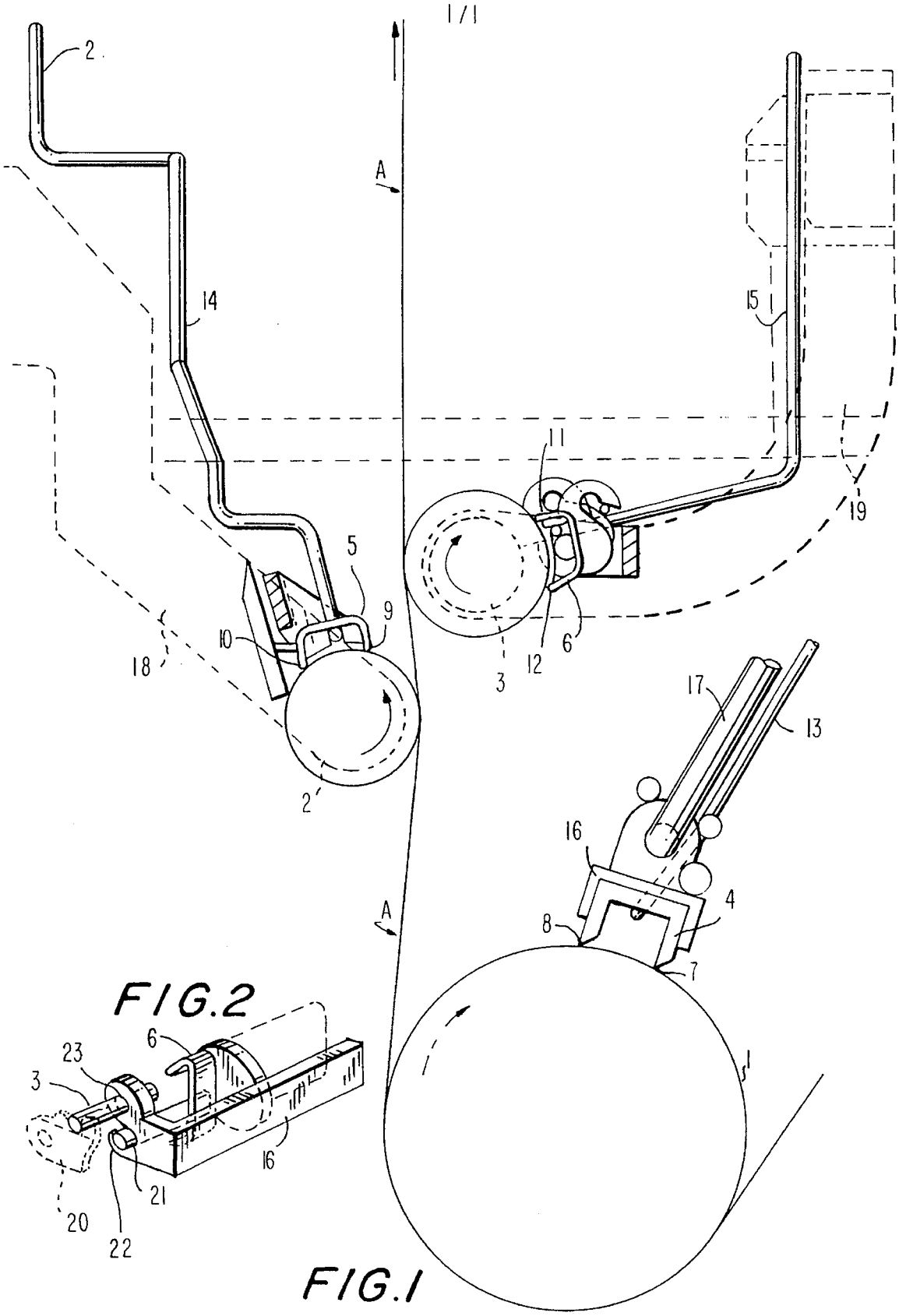
FIG. 1 is a side view of the rollers and scrapers assembly and accessory parts; and, FIG. 2 is a perspective view of a scraper holder, showing the forming elements thereof.

As shown in the attached drawings, the present invention includes improvements to rollers immersed in metal alloy baths, wherein the improvements include providing elements immersed in a molten alloy bath, in order to avoid building up of inter-metallic alloys on the respective surfaces of rollers 1, 2 and 3. These elements are basically scrapers 4, 5 and 6 which scrapers 4, 5 and 6 do not prevent the normal rotation of rollers 1, 2 and 3 respectively, due to the drag of steel band A and wherein scrapers 4, 5 and 6, at the same time, due to the friction of the pairs of two hard steel cutting edges 7 and 8; 9 and 10; 11 and 12, respectively, on the surfaces of rollers 1, 2 and 3, avoid an adhesion of alloys on the roller surfaces.

In order to improve the mechanical scraping action of scrapers 4, 5 and 6, and to facilitate normal rotation of rollers 1, 2 and 3, and as a novel improvement in hardened steel scrapers 4, 5 and 6 inert gas is injected at an end of scrapers 4, 5 and 6. The inert gas flows along each respective 4, 5 and 6 scraper and is carried by conduits 13, 14 and 15 and onto each roller face of rollers 1, 2 and 3. The gas current exits through the contact line between respective scrapers 4, 5 and 6 and respective rollers 1, 2 and 3. The remaining inert gas exhausts through the free end of respective scrapers 4, 5 and 6. This results in a more intense mechanical scraping as well as an easy roller rotation.

As shown in FIG. 2, rollers 1, 2 and 3 are freely supported at one of their respective ends on a fixed arm 20.

Scrapers 4, 5 and 6 are mounted on similar scraper-supporting bodies 16, each scraper supporting body 16 having free bearing means 22 for shaft 21 on which they are fixedly articulated. Further, scraper supports 16 has a bush-like free space 23 for the respective rollers 1, 2 and 3. Roller 1, scraper 4 and scraper-supporting body 16 are supported by support member 17. Roller 2 and scraper 5 are supported by a scraper-supporting body similar to scraper-supporting body 16, as well as by support member 18. Roller 3 and scraper 6 are also supported by a scraper-supporting body similar to scraper-supporting body 16, as well as by support member 19.

With the referred improvements, the useful lives of rollers 1, 2 and 3 immersed into the alloy bath are extended from several days to several weeks.

OPERATION

Steel strip A rises within the fluid mass by mechanical traction, thus acting and driving a plurality of rollers including roller 1, stretching roller 2 and fixed roller 3. such strip A contacts the three rollers 1, 2 and 3 in correspondence with their outer surfaces, i.e. with an approximately tangent contact upon the respective outer surfaces of rollers 1, 2 and 3.

During rotation of the three rollers 1, 2 and 3, scrapers 4, 5 and 6, respectively, act on the roller surfaces of rollers 1, 2 and 3.

Scrapers 4, 5 and 6 scrape, with their respective pairs of cutting edges 7 and 8, 9 and 10, and 11 and 12 against foreign matter produced by inter-metallic alloys formed by the steel bath reacting with the respective surfaces of rollers 1, 2 and 3. Friction of the respective pairs of cutting edges 7 and 8, 9 and 10, and 11 and 12 is supported by the inert gas stream forced through conduits 13, 12 and 15 to the corresponding scraper supports 16. This gas acts along respective cutting edges against the surfaces of cylinders 1, 2 and 3. The inert gas preferably includes nitrogen under pressure of from 0.1 $kg/cm^2$ and 5 $kg/cm^2$ at the ends of respective scrapers 4, 5 and 6.

Foreign matter thus withdrawn returns to the molten mass floating thereon being removed by proper conventional removal means.

With the above mentioned improvement, the life of rollers immersed into alloy baths may be extended from several days to several weeks, thereby avoiding frequent production showdowns for replacing of the rollers.

Other modifications may be made to the present invention without departing from the scope of the invention, as noted in the appended claims.

We claim:

1. A process for extending the life of rollers used in formation of steel sheet bands, comprising the steps of immersing the rollers into an alloy bath through gas feeding, applying at least one mechanical scraper means with hard steel cutting edges against each roller surface of the rollers, and providing a source of inert gas to provide a fluid action by injecting said inert gas through an inner portion of said mechanical scraper.

2. The process as claimed in claim 1, wherein said scraper is fed with nitrogen under pressures comprised between 0.1 $kg/cm^2$ and 5 $kg/cm^2$ from an end of said mechanical scraper.

3. The process as claimed in claim 1, wherein said scraper is fed with inert gas, said gas being nitrogen, said scraper acting inside the molten alloy bath in continuous coating lines by heat immersion of a steel band, thus improving the extended life of said rollers from several days to several weeks.

* * * * *